US007346517B2

(12) United States Patent
Ferris et al.

(10) Patent No.: US 7,346,517 B2
(45) Date of Patent: Mar. 18, 2008

(54) METHOD OF INSERTING ADDITIONAL DATA INTO A COMPRESSED SIGNAL

(75) Inventors: Gavin Robert Ferris, London (GB); Michael Vincent Woodward, London (GB)

(73) Assignee: Radioscape Limited, London (GB)

( * ) Notice: Subject to any disclaimer, the term of this patent is extended or adjusted under 35 U.S.C. 154(b) by 624 days.

(21) Appl. No.: 10/467,544

(22) PCT Filed: Feb. 8, 2002

(86) PCT No.: PCT/GB02/00554

§ 371 (c)(1),
(2), (4) Date: Jan. 8, 2004

(87) PCT Pub. No.: WO02/065651

PCT Pub. Date: Aug. 22, 2002

(65) Prior Publication Data

US 2004/0114687 A1 Jun. 17, 2004

(30) Foreign Application Priority Data

Feb. 9, 2001 (GB) ..... 0103245.7

(51) Int. Cl.
*G10L 19/02* (2006.01)

(52) U.S. Cl. ..... 704/501; 704/200.1

(58) Field of Classification Search ..... 704/270, 704/500–504

See application file for complete search history.

(56) References Cited

U.S. PATENT DOCUMENTS 6,532,445 B1 * 3/2003 Toguri et al. ..... 704/270
6,678,657 B1 * 1/2004 Bruckner et al. ..... 704/240
6,901,368 B1 * 5/2005 Ono ..... 704/500

* cited by examiner

*Primary Examiner*—Abul K. Azad
(74) *Attorney, Agent, or Firm*—Synnestvedt & Lechner LLP

(57) ABSTRACT

Many compressed audio or video frames contain silence (if audio), or a blank image (if video); these essentially information content free (e.g. silent if audio or blank if video) frames can be both detected whilst still in compressed form and then used to carry the additional data. In an MPEG implementation, subbands associated with silent frames are rendered digitally silent and then used to carry PAD (Programme Associated Data).

19 Claims, 1 Drawing Sheet

METHOD OF INSERTING ADDITIONAL DATA INTO A COMPRESSED SIGNAL

BACKGROUND TO THE INVENTION

1. Field of the Invention

This invention relates to a method of inserting additional data into a compressed signal. For example, it relates to a method of inserting additional data into an audio or video frame.

2. Description of the Prior Art

Inserting additional data into a compressed signal, such as an audio or video frame, is well known. For example, the MPEG1 audio standard (ISO 11172-3, Information technology—Coding of moving and associated audio for digital storage media at up to about 1.5 Mbit/s) allows for the insertion of 'ancillary data' into a MPEG frame. This 'ancillary data' is inserted into a 'ancillary data portion' of the frame. By 'ancillary data' we refer to data not needed to decode the media data content in the frame (e.g. compressed audio or video data) according to the normal decoding rules or methods. 'Media data' refers to data that is needed to decode and generate uncompressed media from the frame (e.g. uncompressed audio or video). Media data is placed in the 'media data portion' of a frame; in MPEG 1, this comprises 32 sub-bands at varying scale factor levels. The ancillary data portion is used, for example, in DAB (Digital Audio Broadcasting to carry Programme Associated Data (PAD). It is also used to store information in MP3 data files using the ID3 format (see www.id3.org).

There are currently two principle means of inserting additional data into frames: both mechanisms insert the extra data into the ancillary data portion of a frame, as opposed to modifying the media data portion itself. The first mechanism involves reserving a known number of bytes of each MPEG audio frame for additional non-audio data. This involves an instruction to the MPEG encoder which 'leaves blank' the desired number of bytes; the ancillary data portion occupies this space. So, some audio quality is sacrificed for data insertion. This mechanism is supported by a number of MPEG encoders and is used in DAB (Digital Audio Broadcasting).

The second mechanism involves using VBR (Variable Bit Rate coding). In this scheme, an upper limit is specified for the size of the MPEG frame. The size of the encoded audio frame depends on the audio data being coded. If the data can be encoded in less than the upper limit, then it will be. The data insertion software would then claim any unused space below the upper limit for use as an auxiliary data portion. At the time of writing, most MPEG encoders do not support VBR coding.

Reference may also be made to a third (and quite unusual) technique: WO 00/07303 shows inserting extra data into the media data portion of a frame, rather than the auxiliary data portion of a frame. This is achieved by analysing the sub-bands in a frame and in effect adding data under the perceptible noise threshold of a sub-band.

The present invention relies on the detection of data frames that contain no information bearing data (e.g. audio silence or blank video), so it is also necessary to describe the prior art relevant to information loss detection. Being able to detect the presence or absence of information content in a compressed signal is a common requirement in many systems. For example, the compressed digital audio output from equipment used in broadcasting digital radio is usually monitored so that any silences lasting more than a set time period can be investigated in case they indicate a human error, or a software or equipment failure. More specifically, analysing a compressed signal for the presence or absence of information content may be used to detect when an audio service is no longer supplying audio to a DAB multiplexer, or in a video multiplexer to detect when one of the video channels suffers an audio or video loss.

The conventional approach to monitoring for losses of data in a compressed signal involves first fully decompressing the signal to a digital format (e.g. rendering it to PCM in the case of audio). It is the decompressed, digital signal which is then examined for silence (if audio) or lack of an image (if video) by comparing the decompressed digital signal against pre-set thresholds indicative of the presence or absence of information. If the compressed signal was taken from a digital source (e.g. a digital audio feed from a CD player), then this detection is relatively straightforward: the compressed signal is decompressed and the resultant PCM signals examined for events of zero amplitude: these correspond to the absence of any information content (e.g. silence in an audio frame), which may indicate a human error, or a software or equipment failure. If the signal was sourced from an analogue source prior to digitisation, then the procedure is more complex. An analogue source will never give true silence or lack of image. This analogue signal will pass through a digitising system and in most cases the resulting compressed signal will not be a 'digital zero' even when no genuine information is being carried. Hence, when decompressed, the resultant digital signal will also not be a digital zero even when no genuine information is being carried. In this case, the silence detecting system will have to apply some threshold based algorithm for deciding whether the signal contains data or not.

Although decompression is usually designed to be easier than compression, the decompression overhead is still significant Whilst silence detection could be done at the digitising system, this may not be convenient for the broadcaster as the digitising system may be some distance from the multiplexer (and in fact could be owned and operated by a third party).

SUMMARY OF THE PRESENT INVENTION

In accordance with the present invention, a method of inserting additional data into a compressed signal comprises the steps of:

(a) detecting whether the information content of a media data portion of a frame in the compressed signal falls, in whole or part, below a threshold;

(b) discarding the whole or part of any such media data portion which falls below the information content threshold;

(c) inserting the additional data into an ancillary portion of the frame to occupy space vacated by the discarded portion.

In an implementation of the present invention, a silence or blank image detection algorithm is used to detect silent or blank whole frames: for example, frames that contain audio or video data that fall below some information content threshold value will be considered to be silent or blank. The majority of the bytes in the silent or blank frame may then be discarded (i.e rendered digitally silent or blank) and the space they occupied used for the insertion of additional data, such as non-audio or non-video data, by creating or expanding an ancillary data portion. In a different implementation, specific sub-bands in the media data portion of a frame, which are associated with information content below a threshold, are set to digital zero and the liberated space used to expand the ancillary data portion to carry the extra data payload.

Implementations of the present invention are predicated on a key insight: many compressed audio or video frames contain silence (if audio), or a blank image (if video); the original information content of the frames is low or even zero (e.g. silent if audio or blank if video). These frames can be both detected whilst still in compressed form and then altered to carry the additional data by creating or expanding an ancillary data portion. The main advantages over prior art approaches are that no decompression is needed to identify 'silent' frames and that the extra data is not embedded into the media data portion of a frame (necessitating modified decoders) but instead utilises the standard ancillary data portions; no modification to existing frame structures takes place.

In CBR (Constant Bit Rate) coding, silent or blank frames consume the same amount of data as frames which contain audio or images. In VBR, these frames ought to be more compressed, but this compression will depend on the coding algorithm used. The present invention has the advantage that it is independent of the type of coding used (CBR or VBR) and may therefore be used in situations where it is impossible or impractical to change the original coding of the audio or video signal.

An implementation of the invention is particularly useful for inserting PAD (Programme Associated Data) into MPEG frames when used in a DAB ensemble. Audio silences will tend to occur at the start or end of a piece of music on a music channel, at the start or end of a commercial break, or prior to news or traffic announcements. These are exactly the times at which a broadcaster may wish to transmit more PAD.

In other aspects of the invention, there are:

Computer software adapted to perform the above inventive methods;

Computer hardware adapted to perform the above inventive methods;

Chip level devices adapted to perform the above inventive methods (e.g. DSPs or FPGAs).

DETAILED DESCRIPTION

Figure 1:
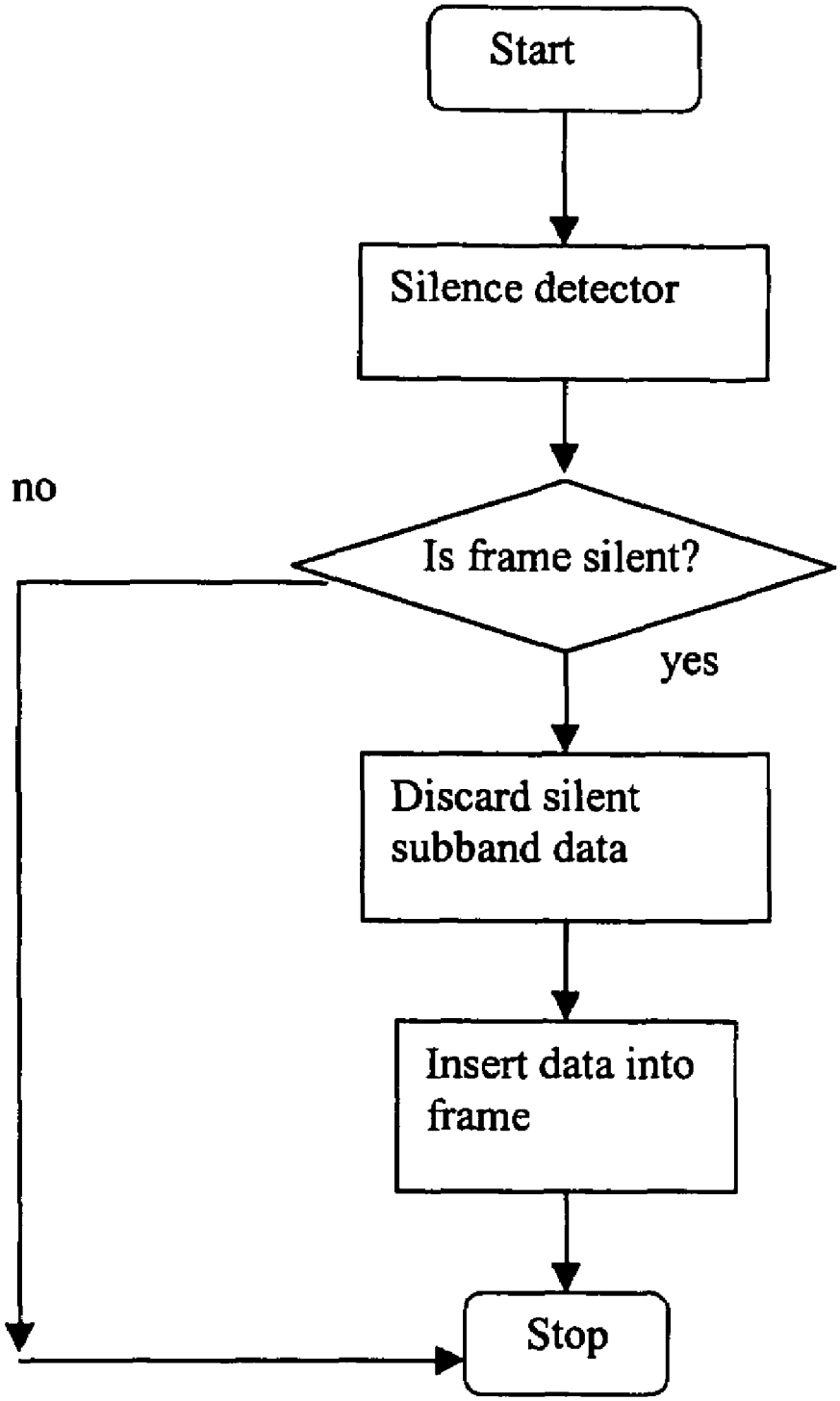
FIG. 1 shows a flowchart for an implementation of the current invention.

The present invention will be described in terms of the insertion of PAD into MPEG audio frames. This should be taken as an example only and is not a limitation on the scope of the present invention.

An MPEG audio frame [ISO 11172-3, Information technology—Coding of moving pictures and associated audio for digital storage media at up to about 1.5 Mbit/s—part 3: audio, 1993] contains data sampled in the time domain and transformed into the frequency domain. The frequencies so obtained are grouped together into subbands and amplitude information for these subbands are calculated. This amplitude information is known as the scale factors. Hence, a MPEG audio frame includes amplitude information coded as scale factors.

An analogue silence will have some random fluctuations, but the scale factor indices during silence will tend to be high (meaning that the scale factors themselves will tend to be low).

The present implementation calculates an average scale factor for all subbands in a frame with non-zero bit allocation. If this mean scale factor is less than a threshold value, then the entire frame is considered silent. (Median or mode values can be used in place of mean in some circumstances). The threshold value can be determined by experimentation with equipment that digitises analogue signals, and the value can be changed by the user (values of 0.0001 or −50 dB may be used, but note that the threshold values will change depending on the analogue/digital systems used). It is very easy to extract scale factor information (using scale factor indices or values) from MPEG audio frames, so that detecting silence with this technique may be applied without adding very much to the processing requirements of a system.

If the audio frame is considered to be silent by the silence detection algorithm, the entire MPEG frame will be altered so that all of the subbands are allocated zero bits. The subband data itself is then discarded. In other words, the frame is made digitally silent. This means that all the bytes consumed by the audio data are now free and may be used for the insertion of additional data.

Another implementation would detect silence in some of the subbands (or partial subbands) and claim the audio data in these subbands. This would be useful where the frame contained definite audio signals, but where some of the subbands (or parts of subbands) contained low volume data around the noise level In this case, the low volume data would be set to digital silence and the space gained used for data insertion by expanding the ancillary data portion.

Another implementation uses a psycho-acoustic or masking model to determine threshold levels; the model may indicate that some subband data is masked (i.e. would be imperceptible to the user) and could therefore be set to digital zero and so claimed for data insertion. The psycho-acoustic model may indicate that some subbands are non-optimally quantised and could be compressed further. In this case, the extra data space gained by the requantisation would be used for data insertion. Note that the use of a sophisticated model or algorithm could reduce the bit rate without impacting the perceived audio quality.

In a more sophisticated implementation, some level of 'comfort noise' would be left in or introduced into the MPEG frame if data was removed by silence detection. This might be useful where the source data stream was an analogue one. The sudden change to digital silence may lead the listener into concluding that the audio system has ceased to function; leaving in 'comfort noise' alleviates this problem.

As an alternative to leaving 'comfort noise' in the frame, only some of the subband data could be discarded. In this implementation the silence detector would decide that the frame was silent overall, but instead of setting all subband data to zero, only the quietest subbands would have their data set to zero (e.g. the quietest 70% of subbands, or the higher frequency subbands etc.). In this way there would still be some nominal level of sound, but one would still be able to insert an increased amount of data into an expanded ancillary data portion of a frame. Because the additional data is inserted in the ancillary data (or non audio/video) portion of the frame, no special decoders are needed. This makes this invention especially suitable for use in broadcast based applications.

Note that the frames produced at the end of the box headed 'Discard silent subband data' in FIG. 1 will be valid MPEG frames regardless of whether extra data is inserted into the frame later or not. This means that, should the data insertion system not be able to insert data, the frame could be broadcast without further processing. Phased implementation of the present system is therefore possible.

The invention claimed is:

1. A method of inserting additional data into a compressed signal comprising the steps of:

(a) detecting whether the information content of a media data portion of a frame in the compressed signal falls, in whole or part, below an information content threshold indicative of silence for an audio frame and blankness for a video frame, without decompressing the frame;

(b) discarding the whole or part of any such media data portion which falls below the information content threshold;

(c) inserting the additional data into an ancillary portion of the frame to occupy space vacated by the discarded media data portion.

2. The method of claim 1 in which the compressed signal is a frequency domain representation with sub-bands and, for the whole or part of any media data portion of a frame for which the original information content falls below the information content threshold, some or all of the data in the subbands is discarded.

3. The method of claim 2 in which some of the data in the subband is deliberately left in the media data portion of a frame or applicable part of a frame, despite falling below the information content threshold.

4. The method of claim 2 in which noise is deliberately introduced into the media data portion of a frame or applicable part of a frame which has been discarded.

5. The method of claim 2 in which the step of detecting whether the original information content of a media data portion of a frame falls, in whole or part, below the information content threshold comprises the following steps:

(a) examining amplitude data coded in the compressed signal;

(b) determining the presence or absence of information content in the compressed signal in dependence on the results of the amplitude examination.

6. The method of claim 5 in which the examination of the amplitude data coded in the compressed signal involves a comparison to a threshold value.

7. The method of claim 5 in which the amplitude data is coded as scale factors.

8. The method of claim 5 in which an average scale factor for a given media data portion of a frame, being a mean, median or mode, is used in the amplitude examination.

9. The method of claim 5 in which scale factor indices are used in the amplitude examination.

10. The method of claim 5 in which scale factor values are used in the amplitude examination.

11. The method of claim 1 where a psycho-acoustic or masking model is used to determine the information content threshold.

12. The method of claim 11 in which the psycho-acoustic or masking model indicates whether any subbands are non-optimally quantised and can therefore be compressed further to enable the ancillary data portion to be increased in size to carry the additional data.

13. The method of claim 1 in which the additional data is PAD.

14. The method of claim 1 where the additional data is MPEG TD3 tags.

15. The method of claim 1 in which the signal is an MPEG signal encoding using CBR.

16. The method of claim 1 in which the signal is an MPEG signal encoding using VBR.

17. Computer software adapted to perform a method of inserting additional data into a compressed signal, said method comprising the steps of:

(a) detecting whether the information content of a media data portion of a frame in the compressed signal falls, in whole or part, below an information content threshold indicative of silence for an audio frame or blankness for a video frame, without decompressing the frame;

(b) discarding the whole or part of any such media data portion which falls below the information content threshold;

(c) inserting the additional data into an ancillary portion of the frame to occupy space vacated by the discarded media data portion.

18. Computer hardware adapted to perform a method of inserting additional data into a compressed signal, said method comprising the steps of:

(a) detecting whether the information content of a media data portion of a frame in the compressed signal falls, in whole or part, below an information content threshold indicative of silence for an audio frame or blankness for a video frame, without decompressing the frame;

(b) discarding the whole or part of any such media data portion which falls below the information content threshold;

(c) inserting the additional data into an ancillary portion of the frame to occupy space vacated by the discarded media data portion.

19. Chip level devices adapted to perform a method of inserting additional data into a compressed signal, said method comprising the steps of:

(a) detecting whether the information content of a media data portion of a frame in the compressed signal falls, in whole or part, below an information content threshold indicative of silence for an audio frame or blankness for a video frame, without decompressing the frame;

(b) discarding the whole or part of any such media data portion which falls below the information content threshold;

(c) inserting the additional data into an ancillary portion of the frame to occupy space vacated by the discarded media data portion.

* * * * *